US010262493B2

(12) United States Patent
Estes et al.

(10) Patent No.: US 10,262,493 B2
(45) Date of Patent: Apr. 16, 2019

(54) NON-GAMING FUNCTIONALITY CONTROL OF GAMING MACHINES INCLUDING AUDIO ASSETS MANAGER

(71) Applicant: AGS LLC, Las Vegas, NV (US)

(72) Inventors: Arles Andrew Estes, Las Vegas, NV (US); Gerald Francis Wasinger, Berkeley, GA (US)

(73) Assignee: AGS LLC, Las Vegas, NV (US)

( * ) Notice: Subject to any disclaimer, the term of this patent is extended or adjusted under 35 U.S.C. 154(b) by 0 days.

(21) Appl. No.: 15/618,417

(22) Filed: Jun. 9, 2017

(65) Prior Publication Data

US 2018/0357855 A1 Dec. 13, 2018

(51) Int. Cl.
*A63F 9/24* (2006.01)
*G07F 17/32* (2006.01)

(52) U.S. Cl.
CPC ..... *G07F 17/3227* (2013.01); *G07F 17/3223* (2013.01); *G07F 17/3288* (2013.01)

(58) Field of Classification Search
CPC ..... G07F 17/3202; G07F 17/3204; G07F 17/3223; G07F 17/3227; G07F 17/323; G07F 17/3255
See application file for complete search history.

(56) References Cited

U.S. PATENT DOCUMENTS 8,342,962 B2 1/2013 Lee et al.
8,808,088 B1 * 8/2014 Brunell ..... G07F 17/3227 463/20
8,821,244 B1 * 9/2014 Detlefsen ..... G07F 17/323 463/16
8,968,092 B2 * 3/2015 Gomez ..... G07F 17/32 463/30
9,126,106 B1 * 9/2015 Brunell ..... G07F 17/3255
9,573,050 B2 2/2017 Thompson et al.
9,607,474 B2 * 3/2017 Nguyen ..... G07F 17/323
2005/0043090 A1 * 2/2005 Pryzby ..... G07F 17/32 463/35
2006/0009285 A1 * 1/2006 Pryzby ..... G07F 17/32 463/30

(Continued)

OTHER PUBLICATIONS

Smiths Medical, Medfusion4000 Wireless Syringe Infusion Pump, printed Nov. 14, 2017, 2 pages, wwww.smiths-medical.com/products/infusion/syringe-infusion-pumps/medfusion-4000-wireless-syring-pump.

*Primary Examiner* — Lawrence Galka
(74) *Attorney, Agent, or Firm* — Weide & Miller, Ltd.

(57) ABSTRACT

A system and method for modifying non-gaming functionality of a plurality of gaming machines is provided. The plurality of gaming machines each includes at least one display device, an audio device, a gaming controller configured to execute machine readable instructions to present one or more games at the gaming machine, and a non-gaming controller configured to execute machine readable instruction to modify one or more non-gaming attributes of the gaming machine. A server is communicatively connected through a network to the plurality of gaming machines. The server is configured to send machine readable instructions through the network to the non-gaming controller to select one or more of the plurality of gaming machines and cause the selected one or more the plurality of gaming machines to modify one or more non-gaming attributes of the gaming machine.

16 Claims, 4 Drawing Sheets

(56) References Cited

U.S. PATENT DOCUMENTS

| | | | | |
|---|---|---|---|---|
| 2007/0015570 | A1* | 1/2007 | Pryzby | G07F 17/32 463/25 |
| 2008/0020827 | A1* | 1/2008 | Underdahl | G07F 17/32 463/25 |
| 2008/0234026 | A1* | 9/2008 | Radek | G07F 17/3202 463/16 |
| 2011/0223993 | A1* | 9/2011 | Allen | G07F 17/32 463/30 |
| 2014/0057719 | A1* | 2/2014 | Decker | G07F 17/3211 463/35 |
| 2014/0323212 | A1 | 10/2014 | Thompson et al. | |
| 2014/0329592 | A1 | 11/2014 | Thompson et al. | |
| 2017/0178443 | A1 | 6/2017 | Calhoun et al. | |
| 2017/0178444 | A1 | 6/2017 | Lee et al. | |

* cited by examiner

NON-GAMING FUNCTIONALITY CONTROL OF GAMING MACHINES INCLUDING AUDIO ASSETS MANAGER

FIELD

The disclosed embodiments relate to methods of presenting and playing games and gaming machines configured to present games.

BACKGROUND

Many styles of gaming devices and games are known, including casual (or non-wagering) gaming and wager-based gaming. Such games are often presented via gaming devices, such as those found at a casino, which are commonly referred to as gaming machines, slot machines, etc.

As is known in the industry, wager-based gaming devices, e.g. "gaming machines," are tightly regulated. Different jurisdictions have different regulations, but what is actually regulated is fairly consistent. For example, regulations are designed to secure the gaming machine both from tampering by unscrupulous players, but to also prevent casinos from changing the operation of the machine, such as to modify the payout schedule or the like. These and other regulations ensure that all players of a gaming machine get a fair and essentially equal chance to win (or at least that the gaming machine operates consistently relative to all players) and are designed to ensure the security of the machine and verifiability of the game outcomes (for example, regulations generally require certain levels of gaming machine security, including access control by the casino which may include certain monitored key locks and tamper detectors on gaming machine doors and the like, and a mechanism for storing game outcomes for playback).

Due to the tight controls on gaming machines, modification of gaming machines is difficult. Typically, any modification of settings on a gaming machine must be performed by a certified technician who accesses the gaming machine to make the adjustments. This typically is true for gaming machine components that are not specifically regulated, such as speaker volume of a gaming machine. Accordingly, there is a need for an improved method for accessing and modifying features of a gaming machine.

SUMMARY

A system and method for modifying non-gaming functionality of a plurality of gaming machines is provided. As one aspect of the invention, non-gaming functionality or attributes at a gaming machine, such as audio volume and effects, may be managed or controlled remotely via a common control server which sends instructions to a non-gaming controller at each select gaming machine. As another aspect of the invention, non-gaming functionality or attributes such as audio effects may be dynamically controlled or implemented between gaming machines or via a common remote device or server.

In one embodiment, the plurality of gaming machines each includes at least one display device, an audio device, a gaming controller configured to execute machine readable instructions to present one or more games at the gaming machine, and a non-gaming controller configured to execute machine readable instruction to modify one or more non-gaming attributes of the gaming machine. A server is communicatively connected through a network to the plurality of gaming machines. The server is configured to send machine readable instructions through the network to the non-gaming controller to select one or more of the plurality of gaming machines and cause the selected one or more the plurality of gaming machines to modify one or more non-gaming attributes of the gaming machine.

In some embodiments, the one or more non-gaming attributes of the gaming machine comprises a volume level of the audio device.

In one embodiment, the server sends a first package of audio assets to a first active gaming machine from the plurality of gaming machines and a second package of audio assets to a second active gaming machine from the plurality of gaming machine. The first package of audio assets may comprise sound effects that are in musical and/or rhythmical harmony with sound effects of the second package of audio assets.

The sound effects of the first package of audio assets may be based on a tonic of a musical scale, and the sound effects of the second package of audio assets may be based on a third of the musical scale. The sound effects of the first and second packages of audio assets may comprise one or more of win tunes, celebration audio, music loops, and stingers played on the audio device of the first and second active gaming machines.

In another embodiment, a gaming system for managing audio assets is provided. The system includes a plurality of gaming machines each comprising at least one display device, an audio device, and a gaming controller configured to execute machine readable instructions to present one or more games at the gaming machine. The system also includes a server communicatively coupled to the plurality of gaming machines. The server is configured to identify a first active gaming machine and a second active gaming machine from the plurality of gaming machines. The server sends a first package of audio assets to the first active gaming machine and sends a second package of audio assets to the second active gaming machine. The first package of audio assets comprises sound effects that are in musical and/or rhythmical harmony with sound effects of the second package of audio assets.

The sound effects of the first package of audio assets may be based on a tonic of a musical scale and the sound effects of the second package of audio assets may be based on a third of the musical scale. The sound effects of the first and second packages of audio assets may comprise one or more of win tunes, celebration audio, music loops, and stingers played on the audio device of the first and second active gaming machines.

In a further embodiment, there is method for modifying non-gaming functionality of a plurality of gaming machines. The method may comprise connecting a non-gaming server to a non-gaming controller of a plurality of gaming machines via a network. Each of the plurality of gaming machines may comprise the non-gaming controller, a main gaming controller, at least one display device, and an audio device. The method further comprises selecting one or more gaming machines of the plurality of gaming machines to control, and sending control instructions to the selected gaming machines to modify at least one non-gaming attribute of the selected gaming machines.

In one instance, the at least one non-gaming attribute of the gaming machine comprises a volume level of the audio device.

According to one embodiment, the selected gaming machines comprise a first active gaming machine and a second active gaming machine. The server may send a first package of audio assets to the first active gaming machine and a second package of audio assets to the second active gaming machine. The first package of audio assets may comprise sound effects that are in musical and/or rhythmical harmony with sound effects of the second package of audio assets.

The sound effects of the first package of audio assets may be based on a tonic of a musical scale and the sound effects of the second package of audio assets may be based on a third of the musical scale. The sound effects of the first and second packages of audio assets may comprise one or more of win tunes, celebration audio, music loops, and stingers played on the audio device of the first and second active gaming machines.

Further objects, features, and advantages of the present invention over the prior art will become apparent from the detailed description of the drawings which follows, when considered with the attached figures.

DETAILED DESCRIPTION OF THE EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise gaming machines and gaming systems. Such a gaming machine may have various configurations.

The gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

Figure 1:
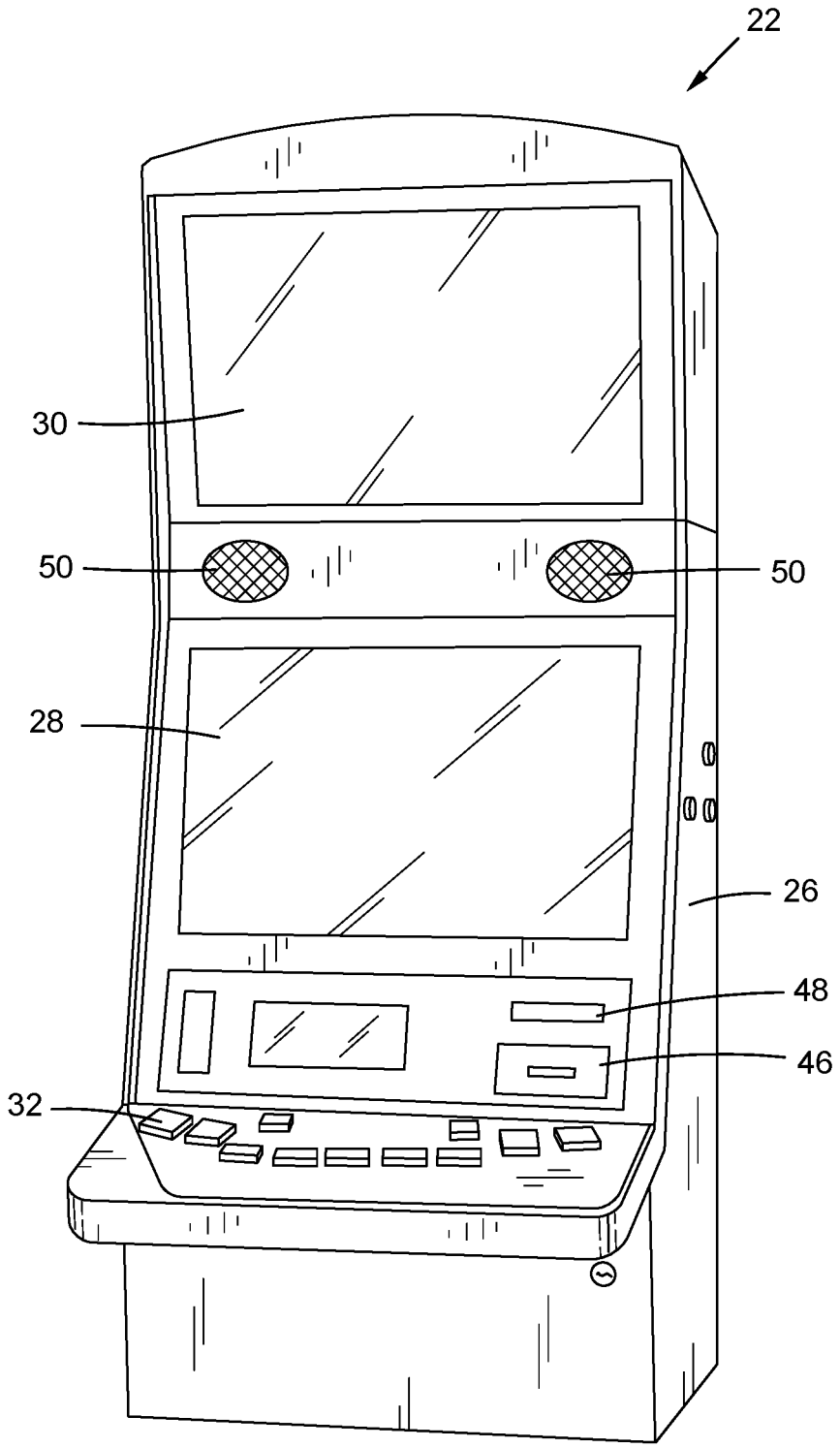
FIG. 1 is a perspective view of one embodiment of a gaming machine in accordance with the invention.

One configuration of a gaming machine 22 is illustrated in FIG. 1. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one first display device 28 configured to display game information. The display device 28 may comprise an electronic video display such as a cathode ray tube (CRT), high resolution flat panel liquid crystal display (LCD), projection LCD, plasma display, field emission display, digital micromirror display (DMD), digital light processing display (DLP), LCD touchscreen, a light emitting diode display (LED) or other suitable displays now known or later developed, in a variety of resolutions, sizes and formats (e.g. 4:3, widescreen or the like). The display device 28 may be capable of projecting or displaying a wide variety of information, including images, symbols and other indicia or information associated with game play, game promotion or other events. The gaming machine 22 might include more than one display device, such as a main or first display device 28 and a secondary display device 30. The two or more display devices might be associated with the housing or, as illustrated in FIG. 1, the gaming machine 22 might also include a top box or other portion which includes the one or more second display devices 30. Also, the gaming machine 22 might include side displays (such as mounted to the exterior of the housing 26) and might include multiple displays of differing sizes.

As described in more detail below, the gaming machine 22 is preferably configured to present one or more games upon a player making a monetary payment or wager. In this regard, as described in more detail below, the gaming machine 22 includes mechanism or means for accepting monetary value.

In one embodiment, certain game outcomes (but preferably not all game outcomes) may be designated as winning outcomes (the non-winning outcomes may be referred to as losing outcomes). Prizes or awards may be provided for winning outcomes, such as monetary payments (or representations thereof, such as prize of credits), or promotional awards as detailed herein. As detailed below, the gaming machine 22 preferably includes a mechanism or means for returning unused monetary funds and/or dispensing winnings to a player.

The gaming machine 22 preferably includes one or more player input devices 32 (such as input buttons, plunger mechanisms, a touch-screen display, joystick, touch-pad or the like). These one or more devices 32 may be utilized by the player to facilitate game play, such as by providing input or instruction to the gaming machine 22. For example, such input devices 32 may be utilized by a player to place a wager, cause the gaming machine 22 to initiate a game, to initiate a reel spin, to "cash out" of the gaming machine, or to provide various other inputs.

Figure 2:
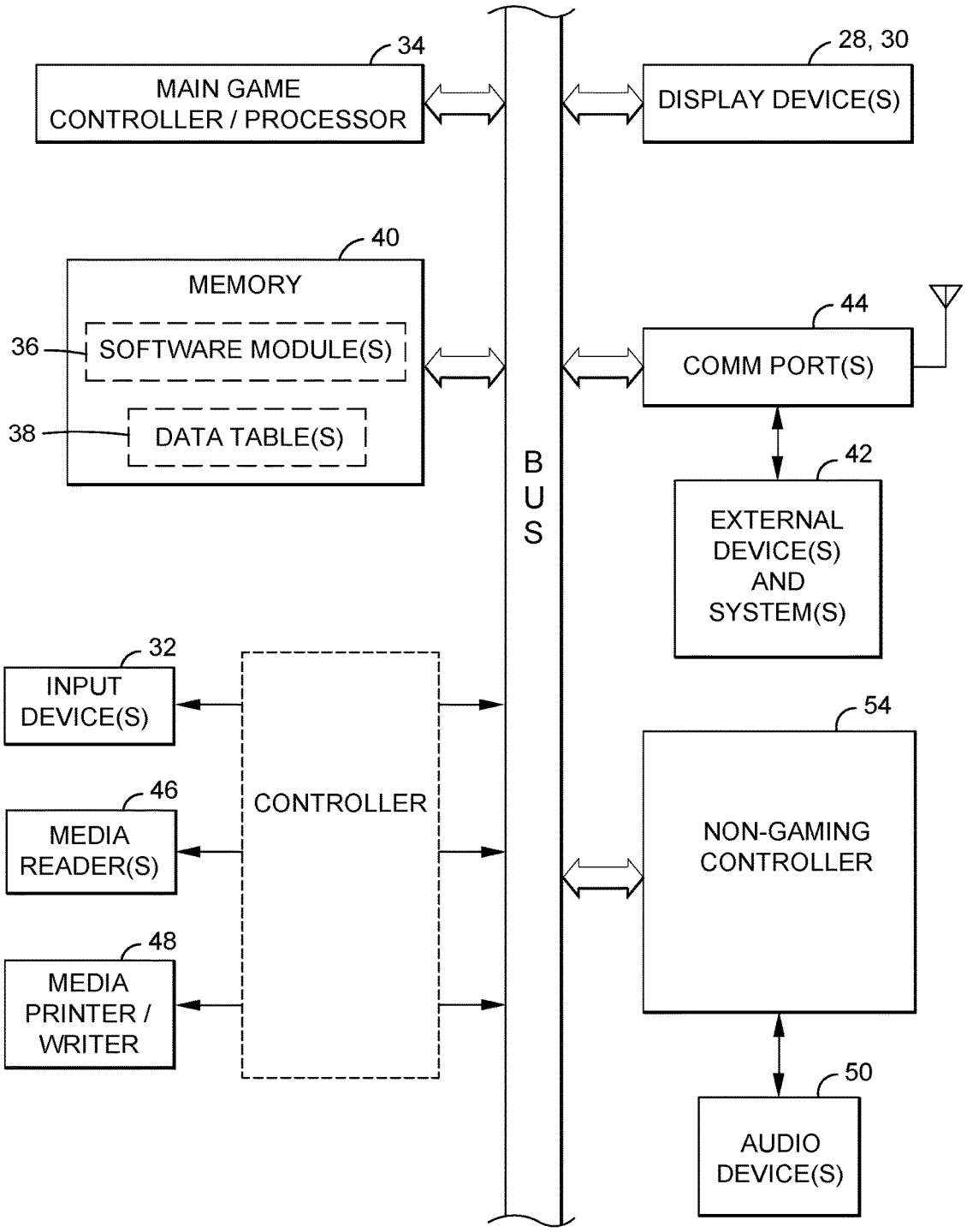
FIG. 2 diagrammatically illustrates a configuration of the gaming machine illustrated in FIG. 1.

Referring to FIG. 2, in one preferred embodiment, the gaming machine 22 includes at least one microprocessor or controller 34 for controlling the gaming machine, including receiving player input and sending output signals for controlling the various components or peripheral devices of the machine 22 (such as generating game information for display by the display devices 28, 30). The controller 34 may be arranged to receive information regarding funds provided by a player to the gaming machine 22, receive input such as a purchase/bet signal when a purchase/bet button is depressed, and receive other inputs from a player. The controller may be arranged to generate information regarding a game, such as generating game information for display by the at least one display device 28, 30, for determining winning or losing game outcomes and for displaying information regarding awards for winning game outcomes, among other things.

The controller 34 may be configured to execute machine readable code or "software" or otherwise process information, such as obtained from a remote server. Software 36 or other instructions may be stored at a memory or data storage device 40, e.g. in a fixed or non-transitory configuration. The memory may also store other information or data 40, such as data stored in table or other forms (including, but not limited to look-up tables, pay tables and other information including tracked game play information). The gaming machine 22 may also include one or more random number generators for generating random numbers (such as implemented by a random number generator software module stored in the memory 40 and executable by the processor 34), such as for use in selecting slot symbols, multiplier values and for presenting a game in a random fashion (e.g. whereby the game is presented in a manner in which the player cannot control the outcome) or pseudo-random fashion (e.g. such as where the game includes a skill component which can affect the outcome of the game).

Preferably, the controller 34 is configured to execute machine readable code or instructions (e.g. software) which are configured to implement the game. In this regard, the gaming machine 22 is specially configured to present a game via specific software and/or hardware which causes the gaming machine to operate uniquely. For example, the controller 34 of the gaming machine 22 may be configured to detect a wager, such as a signal from a player's depressing of the "bet one" button. Upon such an event and/or the player otherwise signaling the gaming machine to present the game, the controller may be configured to cause the at least one display 28 to display unique information, such as a unique graphical interface or unique game display, including game symbols or other game information. The controller may accept input from a player of game inputs, such as a request to spin reels or the like, via the one or more player input devices of the gaming machine 22. As indicated above, the machine-readable code may be configured in various manners, such as by having various "modules" of software which are designed to implement specific features of the game play or game presentation.

The gaming machine 22 may be configured to generate and present games in a stand-alone manner or it may be in communication with one or more external devices or systems 42 at one or more times. The gaming machine 22 might communicate with one or more of such external devices or systems 42 via one or more communication ports 44 or other interface devices. These ports or interface devices 44 may be configured to implement various communication protocols (including proprietary protocols) and communicate via wireless, wired or other communication link. For example, the gaming machine 22 may be configured as a server based device and obtain game code or game outcome information from a remote game server (in which event the gaming machine controller may receive game information from the server, such as game outcome information, and use that server-generated information to present the game at the gaming machine). In another example, the gaming machine may be connected to a server that controls non-gaming functionality and peripherals of the gaming machine, as will be described in more detail below.

As indicated, the gaming machine 22 is configured to present one or more wagering games. The gaming machines 22 is preferably configured to accept value, such as in the form of coins, tokens, paper currency or other elements or devices representing value such as monetary funds. Thus, as indicated above, the gaming machine 22 preferably includes a mechanism or means for accepting monetary value. For example, the gaming machine 22 might include a coin acceptor for accepting coins. Of course, associated coin reading/verifying devices and coin storage devices may be associated with the gaming machine 22 if it is configured to accept coins. Likewise, as illustrated in FIGS. 1 and 2, the gaming machine 22 might include a media reader 46. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read fobs, magnetic stripe cards or other media having data associated therewith and via which value or funds may be associated with the gaming machine 22. The mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications, such as to enable the transfer of funds from the player to the gaming machine or system).

When the player associates funds with the gaming machine or an associated system, a credit balance is generated. The credit balance may comprise a plurality of monetary value credits. The player may wager some or all of the associated monetary value, such as by wagering one or more of the credits associated with the credit balance. For example, the player might provide input to a wager button or touch screen interface to wager a certain number of credits (such as "Bet 1 Credit", "Bet 5 Credits", "Bet Maximum Credits" or other options). In one embodiment, when the player's wager is received, the player's credit balance is reduced by the number of wagered credits. The player might then provide a separate input to begin the game. In other embodiment, the player might select a "play game" input, such as by pressing a "spin" button, which input is taken to comprise both an instruction to place a wager (such as of a pre-set or pre-selected number of credits) and to start the game. Of course, other configurations may be implemented for accepting monetary value from the player and for allowing the player to place a wager from the associated monetary value.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 22 to indicate their desire to cash out, such as by selecting a "cash out" button or touch screen feature or providing other input. In response, a monetary value represented by the player's credit balance or the like is preferably paid, transferred or otherwise provided to the player. For example, upon an award or at cash-out, associated funds may be paid to the player by the gaming machine 22 dispensing coins to a coin tray. In another embodiment, funds may be issued by dispensing paper currency or other media. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference. In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. In this regard, the gaming machine 22 may include one or more media printers or writers 48. In other embodiments, the cash-out mechanism may result in the funds value being transferred to an external device or account, such as a player's casino account (such as associated with a casino server), a remote bank or other financial account, or an electronic device such as a player's phone, PDA or tablet.

The gaming machine 22 may also include a player tracking device, such as a card reader and/or an associated keypad or other input device (such as a touch screen display). Such player tracking devices are well known and may permit the game operator to track play of players of the gaming machine. The tracked play may be utilized to offer player bonuses or awards.

As illustrated in FIG. 2, the main game controller or processor 34 may communicate with several of the peripheral devices via one or more intermediary controllers. For example, some of the peripheral devices might comprise USB type or enabled devices which are controlled by an intermediary USB controller.

The gaming machine 22 may include audio devices 50 such as speakers. The audio devices may create sound effects corresponding to items displayed on the display devices 28, 30, such as a sound effect corresponding to a winning outcome, a spin, a losing outcome, etc. The main gaming controller 34 is configured to output control instructions to the audio devices 50 to generate the sounds in conjunction with gaming and/or other activity at the gaming machine 22.

In one embodiment, a non-gaming controller 54 is provided at the gaming machine 22, as shown in FIG. 2. The non-gaming controller 54 is configured to control non-gaming functionality at the gaming machine (as used herein, "non-gaming functionality" means functionality which does not control or impact the generation of game play data or game outcomes, such as audio features and non-game data presented on one or more displays of the gaming machine; it is noted that while audio features may comprise a part of a game and are generally presented with a game, such features do not impact or alter the outcome of a game played at the gaming machine) and may be connected to one or more external devices and systems 42 via the communication ports 44 through one or more wired or wireless networks. In one example, the non-gaming controller 54 may control a volume level of one or more audio devices 50, a tonic of a musical scale for one or more sound effects, etc. The non-gaming controller 54 is independent from the main game controller 34 and does not impact game play at the gaming machine 22.

The non-gaming controller 54 may control non-gaming functionality of certain attributes of the gaming machine regardless of the input from the main game controller 34. For example, the main game controller 34 may send instructions to the audio devices 50 to generate a certain sound effect corresponding to a game event at the gaming machine 22. The instructions may indicate that the sound effect is generated at a certain volume level (e.g. a level 7 out of 10). In this instance, the non-gaming controller 54 may override the instructions of the main game controller 34 so that the volume of the sound effect is at a different volume level (e.g. a level 5 out of 10). The non-gaming controller 54 might also be configured to adjust a tonality of the sound effect, or to replace a certain sound effect with another sound effect. Similar overrides and control of other attributes of the gaming machine 22 may be controlled by the non-gaming controller 54. In a preferred embodiment, the non-gaming controller 54 may control various peripherals or other devices independent of the main game controller 34. For example, even though the main game controller 34 might not be configured to cause the audio devices 50 to generate audio during idle periods (e.g. during periods when the gaming machine is not being played), the non-gaming controller 54 might be configured or instructed to cause the audio devices 50 to present certain audio when the gaming machine is in an idle mode.

In one embodiment, the non-gaming controller 54 is a hardware based-device, such as a chip (which may be hard programmed or comprise a processor which executes machine readable code), a PCB or the like. In other embodiments, the non-gaming controller 54 may be implemented as a virtual device, such as being implemented as machine-readable code or software (such running in parallel to the gaming machine controller, such as at an operating system level of the machine, depending on the configuration of the gaming machine).

A casino may have numerous such gaming machines 22, such as located on a casino floor or in other locations. Of course, such gaming machines 22 might be used in other environments, such as an airport, a bar or tavern or other locations.

It will be appreciated that the gaming machine illustrated in FIGS. 1 and 2 is only exemplary of one embodiment of a gaming machine. For example, it is possible to for the gaming machine to have various other configurations, including different shapes and styles and having different components than as just described.

The gaming machine 22 may, as noted above, be part of a system which includes other devices. For example, the gaming machine 22 may communicate with one or more casino systems, such as a player tracking server or system, an accounting system or server, a ticketing system, a bonusing system, a tournament system, other gaming machines, and external devices.

Figure 3:
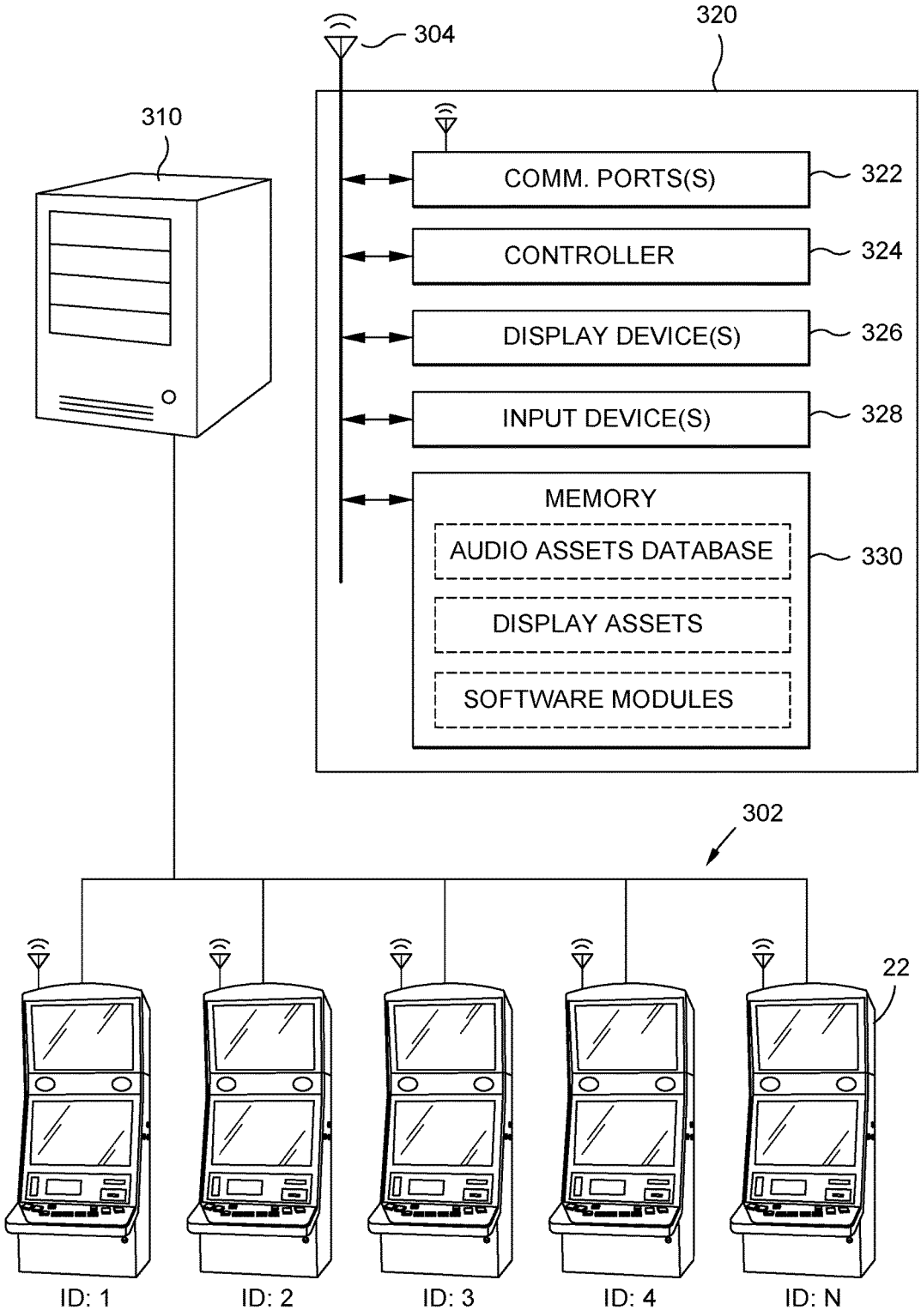
FIG. 3 diagrammatically illustrates a gaming environment with a plurality of gaming machines.

For example, as shown in FIG. 3, a plurality of gaming machines 22 may be located on a casino floor or in another gaming environment. The gaming machines 22 may be connected via a wired network 302 with a casino gaming server 310. The casino gaming server may provide gaming functionality and information to the gaming machines 22 such as to the main gaming controller 34 of the gaming machine 22 (see FIG. 2). For example, a progressive jackpot, random game outcomes, and other gaming information may be communicated to the gaming machine via the network 302. The gaming machines 22 may each have a given identification on the network so as to be selectable and distinguishable on the network. For example, a GUI on server 310 may represent the gaming machines 22 by the identifications ID 1, ID 2, to ID N based on any suitable identification system.

Further, the gaming machines 22 may be connected via a wireless casino network 304 to a non-gaming server or controller 320. The non-gaming server 320 may allow central control for non-gaming functionality at the gaming machines 22 by sending control instructions through the non-gaming controller 54 of the gaming machine 22 (see FIG. 2). While a wireless network is shown in FIG. 3, any suitable networking system may be employed. For casinos that offer class II games, the non-gaming controller 54 may be connected into the existing casino network. For casinos that offer class III games, the non-gaming controller may communicate through a wired or wireless separate, secure, and private casino network. In some embodiments, there may be several non-gaming servers 320 that operate as or with a bank controller that controls a given bank of gaming machines in a gaming environment.

The non-gaming server 320 may comprise several components for implementing non-gaming functionality control of the gaming machines 22. For example, the non-gaming server 320 may have one or more communication ports 322 configured to connect to one or more wired or wireless networks. The server 320 comprises a controller 324 with a processor and associated hardware (member devices, bus, etc.) for running one or more applications (e.g. software executable by the processor and fixed in a tangible medium, such as stored in a memory device) stored on the server. For example, and application for controlling non-gaming functionality may be run using the controller 324.

The application which is executed on the non-gaming server 320 may result in information being displayed on one or more display devices 326. For example, the application may cause the controller of the server 320 to generate a graphical user interface ("GUI") that is presented on the display devices 326 and that allows a user to select one or more gaming machines 22 based on a gaming machine ID, a group of gaming machines, gaming machines in a given location, etc., and various associated functionality. The GUI may also facilitate control instructions to be sent to the gaming machines (and preferably the non-gaming controller thereof) such as to change audio volume levels, or to send updated music or sound effects to a gaming machine 22. The server 320 thus also comprises one or more input devices 328 which allow a user to interface with the server 320. Such input devices may include any device now known or later developed such as a keyboard, mouse, etc. The input device 328 and display device 326 may be integrated in a touchscreen display.

The server 320 also includes one or more data storage devices or memories. The memory 330 is configured to store information such as software modules to run on the controller 324 to present the control interface to a user as described herein. The memory 330 may also include one or more databases including audio assets such as music, sound effects, etc. to send to the gaming machines 22. While the memory 330 is shown as being part of the server 320, the memory 330 may be remote from the server 320 and accessed via one or more wired or wireless networks.

As previously explained, gaming information and wagering game presentation is tightly controlled and regulated at the gaming machine or through a casino gaming network. Accordingly, access to gaming machines, such as to change such gaming information, is tightly monitored (for example, gaming machines general include various security systems and measures, such as door locks, tamper detectors and the like, which are meant to prevent access thereto except by authorized personnel). This, however, also makes it difficult to modify non-gaming functionality at a gaming machine. For example, if a volume level of gaming machines near rooms needs to be lowered during certain hours, a technician would typically need to access each gaming cabinet in order to change the audio settings (such as by using access keys to open the cabinet doors of those machines during periods when they are not being used by players). Furthermore, in some jurisdictions, regulatory personnel are required to oversee the work of the technician accessing any gaming cabinet. Other rules might also be required such as logging technician information at each cabinet accessed, etc. In short, modification of a gaming machine typically requires a substantial amount of effort and coordination.

However, in the modified gaming machine described herein, non-gaming functionality is controlled via the non-gaming controller 54, which itself can be controller or access remotely via a casino network 304. In this manner, non-gaming functionality of the gaming machine can be controlled separately from the regulated gaming information and without the need to physically access the interior of the gaming machine. This allows for convenient and entertaining modifications of one or more gaming machines.

Figure 4:
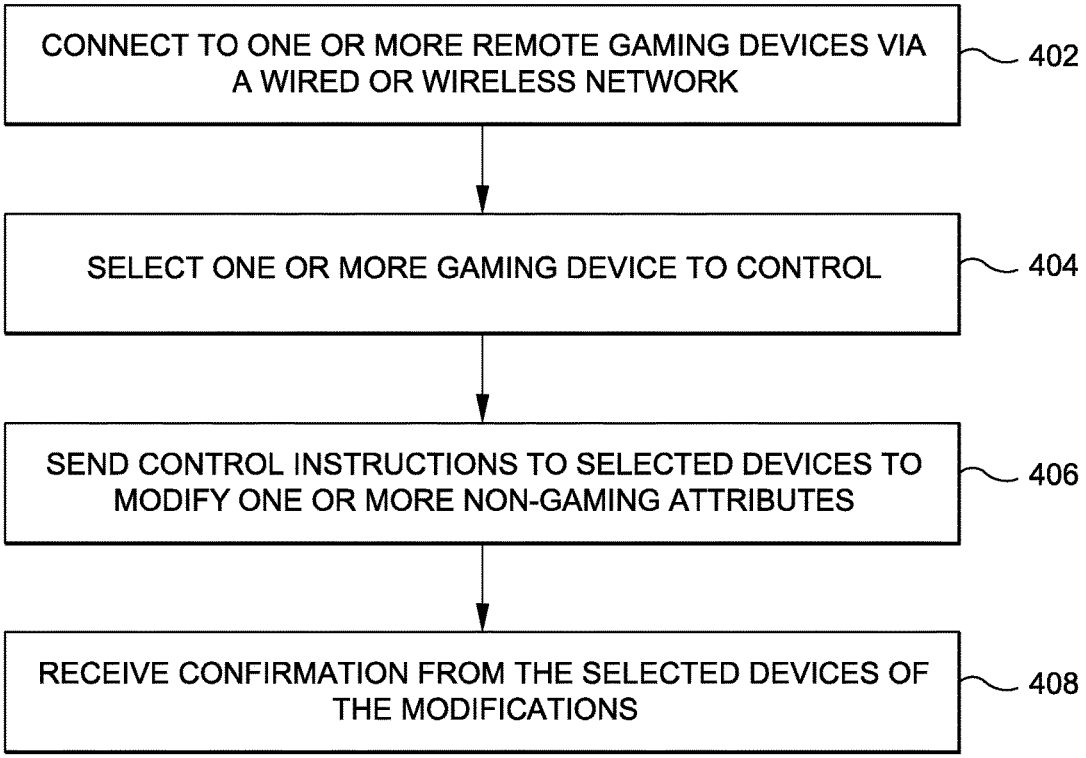
FIG. 4 illustrates a flow chart for controlling non-gaming functionality for one or more gaming machines.

For example, FIG. 4 shows a method of controlling non-gaming functionality for one or more gaming machines. In step 402, a server or computing device is connected to one or more remote gaming machines via a wired or wireless network. For example, as described above in FIG. 3, several gaming machines 22 may be connected to server 320 via wireless network 304. The connection allows control instructions to be transferred from the server to the gaming machines to control non-gaming functionality according to software and hardware installed on the gaming machines.

In step 404, one or more gaming machines are selected to control non-gaming functionality. The server or computing device may have a display interface using, for example, a graphical user interface to select one or more gaming machines (such as by location, ID, etc.). The interface may be provided via a remote dashboard application run on the server or computing device to allow the operator to configure and/or monitor a plurality of gaming machines. Via the interface and application, the user might input to the server via a keyboard, mouse, touchscreen, etc. a selection of one or more of the gaming machines. The interface may group the gaming machines that are connected to the server. In one embodiment, the grouping may be based on the physical location of the gaming machines within a gaming environment. The gaming machines might also be grouped by game type or by any other suitable categorical grouping.

In one embodiment, the user may desire to adjust a volume level of a group of gaming machines that are located near guest rooms at a casino. For example, the volume level may need to be adjusted in the evening hours to ensure casino guests that are in their rooms are not disturbed by the gaming machines. Therefore, in step 404, the user may select a group of gaming machines that are located near the guestrooms. Of course, the user may select any number of gaming machines up to all of the gaming machines.

Next in step 406, control instructions are sent from the server to the selected devices via the network to modify one or more non-gaming attributes. Continuing with the example above, the user at the server may send instructions via the interface to decrease the volume of the selected machines that are located close to guest rooms at a casino. In particular, relative to the embodiment described above, the control instructions are sent from the server to the non-gaming controllers of the gaming machines. The non-gaming controllers then execute or implement the instructions, such as by generating appropriate peripheral device control instructions (to thereby control the designated peripheral devices, such as the audio devices).

In some embodiments, the control instructions may be sent manually by a user. In some embodiments, the control instructions may be automatically generated based on a predetermined schedule, triggering event, or other rule-based criteria. In the above example, the user may schedule the volume of the selected gaming machines to decrease at a specified time each evening. The server then connects with, selects, and sends the control instructions to the gaming machines at that time each evening to control the volume of the gaming machines.

In an exemplary embodiment, such a system might be used to dynamically control sound effects across a plurality of gaming machines. The gaming machines connected via the network and the server may be configured to coordinate audio effect during, for example, game play. In one example, two or more gaming machines that are located in the same area of a gaming environment, such as a "bank" of gamine machines, may be selected to have coordinating audio sound effects. The selected gaming machines may further be based on "active" gaming machines, i.e. gaming machines that are currently being played by a player or that currently have active player credits on the machine.

When two or more active gaming machines are detected in the same location in a gaming environment, the server may send control instructions to control sound effects on the gaming machines. A first gaming machine of the selected gaming machines may be assigned a first package of audio assets. Similarly, a second gaming machine of the selected gaming machines may be assigned a second package of audio assets. More distinct packages of audio assets may be assigned to any number of selected gaming machines that are active at a certain location. The audio assets are designed such that when multiple machines are active (such as when a player has credits on the machine, a player has identified themselves at a machine such as via a player tracking card or similar identification method) at the same time, the audio assets of one machine will musically coordinate with the audio assets of all other selected machines (or course, other conditions or criteria might be used to trigger dynamic audio asset allocation or implementation).

The coordination of the audio assets of the various machines may produce a desired harmony. In musical terms, harmony refers to the interaction of two or more pitches (notes) sounding at the same time. The resultant chord produced by pitches sounding together can have an almost unlimited overall sound depending on the ratio of the frequencies of the pitches to each other and how many pitches are involved.

As multiple pitches are sounded by a sound source, the sound waves created in the air by those pitches will collide with one another and create a harmony. A sound wave has a frequency (number of wavelengths/second) and one wavelength consists of a single oscillation of air pressure including a point of maximum pressure (peak) and a point of minimum pressure (trough). As the sound waves combine in the air the peaks and troughs sum together and produce a new acoustical system consisting of all the interacting sound waves and this new acoustical system is unique from any of the individual sound waves. This system can be referred to as harmony.

Any collection of pitches sounding together can be said to be in harmony. A further analysis of the overall effect of a harmony (it's relative consonant or dissonant qualities) is ultimately the role of the composer or designer and may be based on the artistic preferences of the composer or the designer.

For example, when a first gaming machine in a predetermined area becomes active, the server assigns the gaming machine the first package of audio assets. The package of audio assets may comprise a set of win tunes based on the tonic of a musical scale (e.g. the note C in the major key of C). When the next machine in the predetermined area becomes active, the next machine is assigned the second package of audio assets which comprises a second set of win tunes. The second set of win tunes may be based on the third of the musical scale (e.g. the note E in the major key of C). By assigning the coordinating audio assets, a pleasant harmony between the win tunes of the two gaming machines is heard together. All additional machines that become active are assigned sets of win tunes based on other notes that continue to build the harmony. This results in a rich musical performance from the entire bank of machines. In this manner, the machines together may be "performed" by an ensemble of players as the players play the games on the gaming machines.

The audio assets may be configured to coordinate in other ways. For example, the audio assets may include rhythmic components that coordinate with other gaming machines to create an interesting and complex rhythmic effect. The control of the audio of the selected gaming machines may include any types of effects such as celebration audio, music loops, stingers, etc. The coordinating effect may also be applied to other non-gaming functionality.

As one example, when a single machine at a bank of gaming machines is being played, it may be configured to use audio asset package A. When a second gaming machine begins to be played, instead of using audio asset package A, it might utilize audio asset package B (which is different than audio asset package A and creates certain coordinating audio effects with the first gaming machine which is using audio asset package A). As another example, when a single gaming machine is being played at a bank of gaming machines, that machine might be configured to use audio asset package A, but when any two or more gaming machines are being played, those machines might both use audio asset package B (which may be configured to present certain coordinating effects), and when three or more gaming machines are being played, those machines might all implement audio asset package C, etc. In this manner, audio assets are dynamically assigned or implemented at gaming machines e.g. the audio assets which are implemented at a gaming machine vary, preferably based upon external criteria, such as based what audio assets other gaming machines are using, such as based upon designated control instructions or other criteria or conditions (such as whether adjacent gaming machines are active or being played, are inactive, are in a particular game state or the like)

It will be appreciated that relative to audio assets and the like, certain data may be stored at the gaming machine (such as in a memory which is associated with the audio device, a sub-controller thereof or the non-gaming controller), or at one or more times certain audio data might be downloaded by the non-gaming server to the gaming machines. This data might comprise, for example, audio files which are executed by the audio device (or associated controller) for causing the audio device to make certain sounds or the like.

Once the control instructions are sent to the selected number of gaming machines, the process proceeds to step 408. In step 408, the server receives confirmation from the selected device of the modification. For example, the gaming machines provide feedback that the volume has been adjusted, that the audio assets have been implemented, or that any other non-gaming modification has been implemented.

The above described system and method may have other configurations and implementations. For example, instead of a single non-gaming server that may select any gaming machine in a gaming environment, there may be multiple non-gaming servers or controllers. For example, the non-gaming server or controller may be a bank controller that controls a specific bank of gaming machines in a gaming environment.

In another embodiment, a peer to peer network may be formed between one or more gaming machines. In this example, when a non-gaming functionality is affected on a first gaming machine, this action is sent to the peer gaming machines which may trigger other non-gaming modification. For instance, when a first gaming machine in a peer-to-peer network becomes active, the first gaming machine activates a first set of sound effects based on a tonic of a musical scale. When a second gaming machine in the peer-to-peer network becomes active, the second gaming machine is triggered to activate a second set of sound effects based on a third of a musical scale. Other similar arrangements may also be implemented. In one embodiment, the peer to peer network and the associated functionality may still be managed remotely, such as via a remote non-gaming server. For example, a use might use the non-gaming server to implement "Audio Scheme 1" at a bank of gaming machines at the entrance to a casino. The gaming machines in that bank may then implement that scheme, which may include the gaming machines of that bank communicating with one another to implement certain audio features based upon the activity at that bank (for example, as noted above, as each gaming machine at the bank is played, it may inform the other machines and the machine may then implement certain coordinating audio features (or if a machine at the bank is no longer being played, it may inform the others so that such features may be adjusted or no longer implemented).

While the term non-gaming server has been used herein to designate a remote computing-type device which may be used to interface with and control the gaming machines, other types of devices other than servers may be utilized (such as laptops, desktops, tablets, or other devices), and such a device or server might be configured to implement various functionality, including gaming functionality.

The above described system and method provide an improved method and system to control the non-gaming attributes of a plurality of gaming machines. Given the tight controls on typical gaming machines, the disclosed systems allow modification to the machines while at the same time not interfering with the controlled gaming functionality of the machines. This is allowed by including a non-gaming controller which does not impact the game play controlled by a game controller or game server.

Furthermore, different and entertaining non-gaming functionality may be provided at multiple gaming machines to further increase the excitement provided by the gaming machines. Such functionality can include the disclosed coordinated harmonies of sound effects or any other configuration.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A system for modifying non-gaming functionality of a plurality of gaming machines, the system comprising:

a plurality of gaming machines each comprising:

at least one display device, an audio device, a gaming controller configured to execute machine readable instructions to present one or more games at the gaming machine, and a non-gaming controller configured to execute audio assets of the gaming machine;

a server communicatively connected through a network to the plurality of gaming machines, the server being configured to send for playback a first package of audio assets to a first gaming machine of the plurality of gaming machines and a second package of audio assets to a second gaming machine of the plurality of gaming machines through the network to the non-gaming controllers of the first and second gaming machines, the first package of audio assets comprising first sound effects having first pitches and the second package of audio assets comprising second sound effects having second pitches different from the first pitches and configured to produce a harmony when played together by the first and second gaming machines.

2. The system of claim 1, wherein the first pitches and the second pitches are different from each other at any given point in time during playback.

3. The system of claim 1, wherein the harmony produced by playback of the first and second audio assets is different than sounds produced during playback of either the first audio asset or the second audio asset.

4. The system of claim 3, wherein the sound effects of the first and second packages of audio assets comprise one or more of win tunes, celebration audio, music loops, and stingers played on the audio device of the first and second gaming machines.

5. The system of claim 1, wherein the sound effects of the first package of audio assets are based on a tonic of a musical scale and the sound effects of the second package of audio assets are based on a third of the musical scale.

6. The system of claim 1, wherein said non-gaming controller is implemented as a virtual device.

7. A gaming system for managing audio assets, the system comprising:

a plurality of gaming machines each comprising:

at least one display device, an audio device, a gaming controller configured to execute machine readable instructions to present one or more games at the gaming machine, and a server communicatively coupled to the plurality of gaming machines, the server being configured to identify a first active gaming machine and a second active gaming machine from the plurality of gaming machines, and send a first package of audio assets to the first active gaming machine and send a second package of audio assets to the second active gaming machine, the first package of audio assets comprising first sound effects having first pitches and the second package of audio assets comprising second sound effects having second pitches different from the first pitches and configured to produce a harmony when played together by the first and second gaming machines.

8. The system of claim 7, wherein the sound effects of the first package of audio assets are based on a tonic of a musical scale and the sound effects of the second package of audio assets are based on a third of the musical scale.

9. The system of claim 7, wherein the sound effects of the first and second packages of audio assets comprise one or more of win tunes, celebration audio, music loops, and stingers played on the audio device of the first and second active gaming machines.

10. The method of claim 7 wherein the first pitches and the second pitches are different from each other at any given point in time during playback.

11. The system of claim 7, wherein the harmony produced by playback of the first and second audio assets is different than sounds produced during playback of either the first audio asset or the second audio asset.

12. A method for modifying non-gaming functionality of a plurality of gaming machines, the method comprising:

connecting a non-gaming server to a non-gaming controller of a plurality of gaming machines via a network, each of the plurality of gaming machines comprising the non-gaming controller, a main gaming controller, at least one display device, and an audio device;

selecting a plurality of the gaming machines to control; and sending for playback a first package of audio assets to a first gaming machine of the plurality of gaming machines and a second package of audio assets to a second gaming machine of the plurality of gaming machines, the first package of audio assets comprising first sound effects having first pitches and the second package of audio assets comprising second sound effects having second pitches different from the first pitches and configured to produce a harmony when played together by the first and second gaming machines.

13. The method of claim 12, wherein the harmony produced by playback of the first and second audio assets is different than sounds produced during playback of either the first audio asset or the second audio asset.

14. The method of claim 12, wherein the sound effects of the first package of audio assets are based on a tonic of a musical scale and the sound effects of the second package of audio assets are based on a third of the musical scale.

15. The method of claim 12, wherein the sound effects of the first and second packages of audio assets comprise one or more of win tunes, celebration audio, music loops, and stingers played on the audio device of the first and second active gaming machines.

16. The method of claim 12, wherein the first pitches and the second pitches are different from each other at any given point in time during playback.

* * * * *